US005802879A

United States Patent [19]

Min

[11] Patent Number: 5,802,879

[45] Date of Patent: Sep. 8, 1998

[54] KNITTING MACHINE YARN RECEIVER WITH ACCUMULATED WASTE DISCHARGE DEVICE

[76] Inventor: Lin Chung Min, No. 4, Aly.122, LN. 352, Sec. 1, Chungshan Rd., Yungho, Taipei, Taiwan

[21] Appl. No.: 781,708

[22] Filed: Jan. 10, 1997

[51] Int. Cl.[6] ..... D04B 15/48

[52] U.S. Cl. ..... 66/132 R; 66/132 T; 242/47.05

[58] Field of Search ..... 66/132 R, 132.7; 242/47.01, 47.04, 47.05

[56] References Cited

U.S. PATENT DOCUMENTS

| | | | |
|---|---|---|---|
| 3,709,444 | 1/1973 | Tannert | 66/132 R |
| 4,574,597 | 3/1986 | Buck et al. | 242/47.01 |
| 4,793,565 | 12/1988 | Fecker | 242/47.01 |
| 5,590,547 | 1/1997 | Conzelmann | 66/132 R |

*Primary Examiner*—Andy Falik
*Attorney, Agent, or Firm*—W. Wayne Liauh

[57] ABSTRACT

An improved yarn receiver for knitting machines includes a driving reel integrally formed by plastics injection with a transmission shaft in the center and a plurality of spaced L-shape struts projecting upwardly around the smooth rim of a bottom flange. A driven reel with a plurality of spaced pillars mating with the sheaths of a bushing reel engages with the driving reel. The struts and pillars are positioned in a staggered manner with each other. A brush member located on a yarn feeding member has its brush tip located between the gap formed by the struts and the pillars. The brush member prevents the yarn wrapped around the struts and pillars from falling off and also discharges accumulated yarn waste therefrom after reaching a predetermined weight.

4 Claims, 7 Drawing Sheets

KNITTING MACHINE YARN RECEIVER WITH ACCUMULATED WASTE DISCHARGE DEVICE

BACKGROUND OF THE INVENTION

1. Field of the Invention

The present invention relates to an improvement of a yarn receiver for use in knitting machines, and, more particularly, to a yarn receiver which can perform its functions without the need for a protrusive wheel flange. Another advantage of the present invention is that it can automatically discharge the accumulated yarn wastes.

2. Description of the Prior Art

The yarn receiver (shown by legend B in FIG. 1) of a conventional knitting machine usually has a wheel flange A for preventing the yarn from falling off. When the receiving and winding yarn consists of a multiplicity of fine filaments, wastes during the knitting process, including the hards and refuses of the yarn, will accumulate on the wheel flange after a period of operation. As a result, the knitting machine should be routinely stopped for clearing these hards and refuses. Otherwise, yarn will get caught by the wheel flange and break. The clearing job is time-consuming. And stopping the knitting machine for such purpose will inevitably reduce operation efficiency and productivity.

SUMMARY OF THE INVENTION

In view of the aforesaid problems, it is therefore an object of this invention to provide an improved yarn receiver, which does not include a wheel flange so that the hards and refuses will not be accumulated thereon. Additionally, a brush means is provided for automatically discharging the hards and refuses out of the knitting machine when reaching a predetermined amount.

It is another object of this invention to provide an improved yarn receiver which has integrally formed driving reel and transmission spindle so that the problem of yarn clamping can be avoided.

It is a further object of this invention to provide an improved yarn receiver for use in knitting machines which includes a brush means for preventing yarn from falling off the yarn receiver.

BRIEF DESCRIPTION OF THE DRAWINGS

The present invention, as well as its many advantages, may be further understood by the following detailed description and drawings in which.

DETAILED DESCRIPTION OF THE PREFERRED EMBODIMENT

Figure 1:
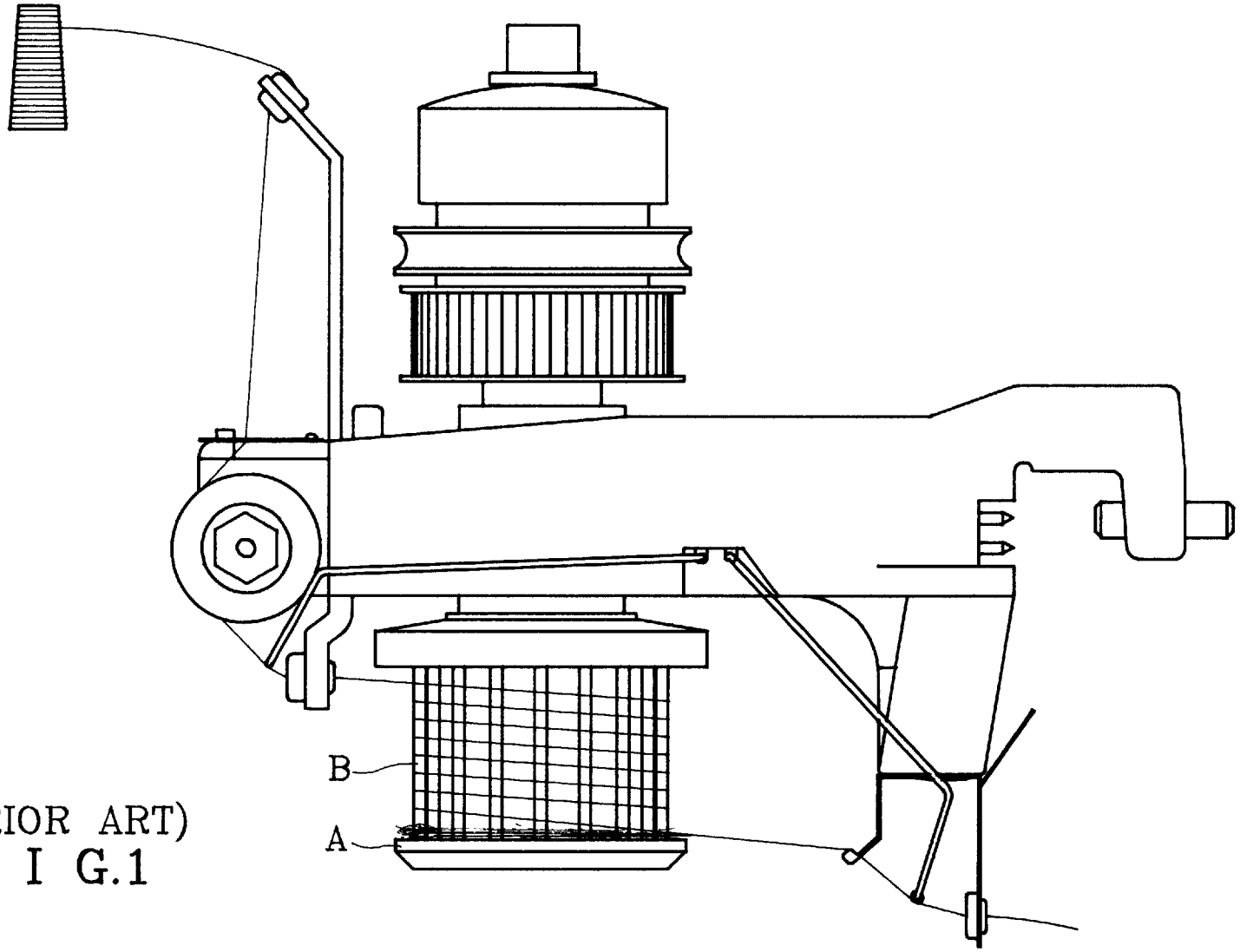
(PRIOR ART) FIG.1
FIG. 1 is a side view of a conventional yarn receiver for knitting machines.
Figure 2:
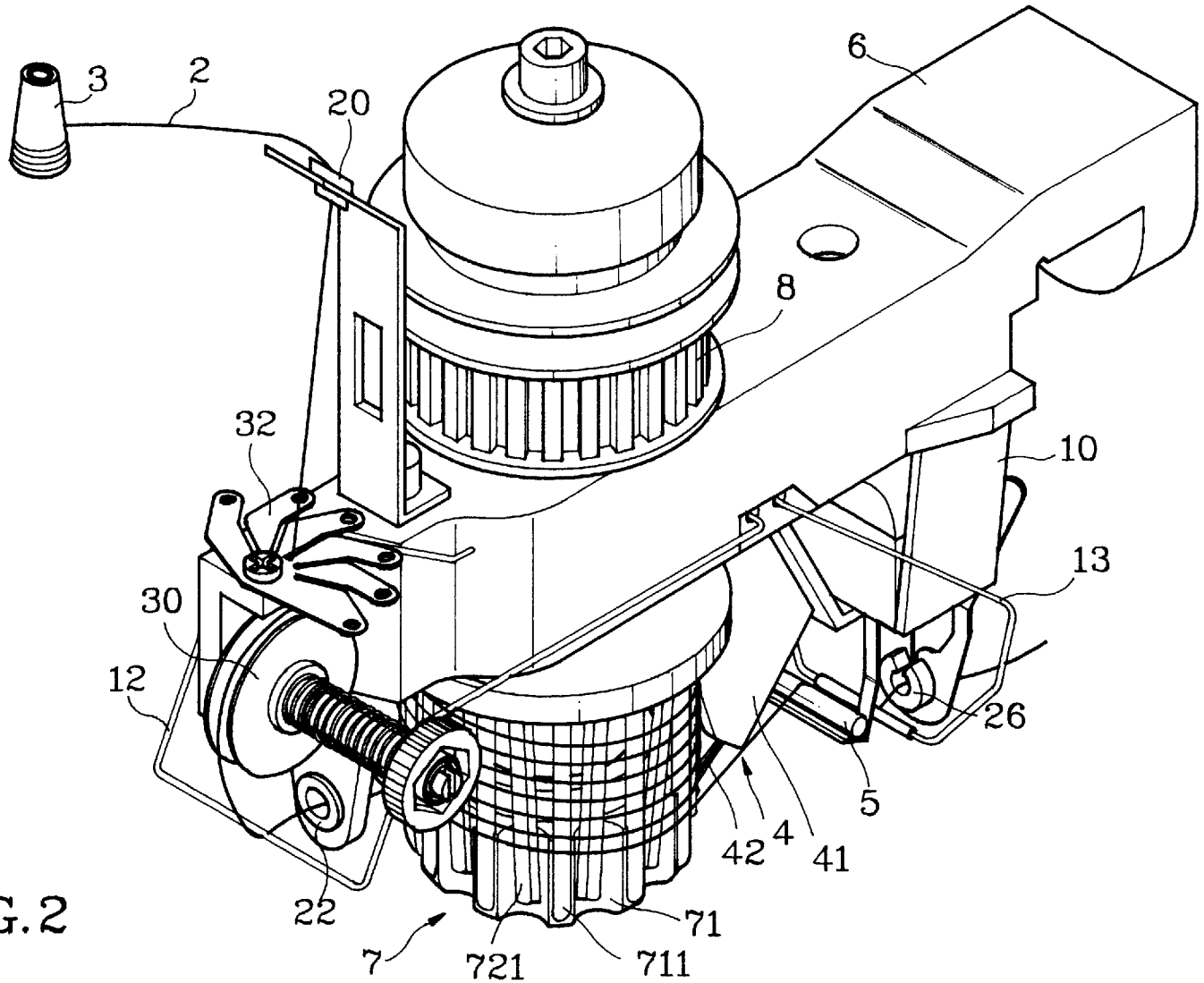
FIG. 2 is a perspective view of a yarn receiver of this invention.
Figure 3:
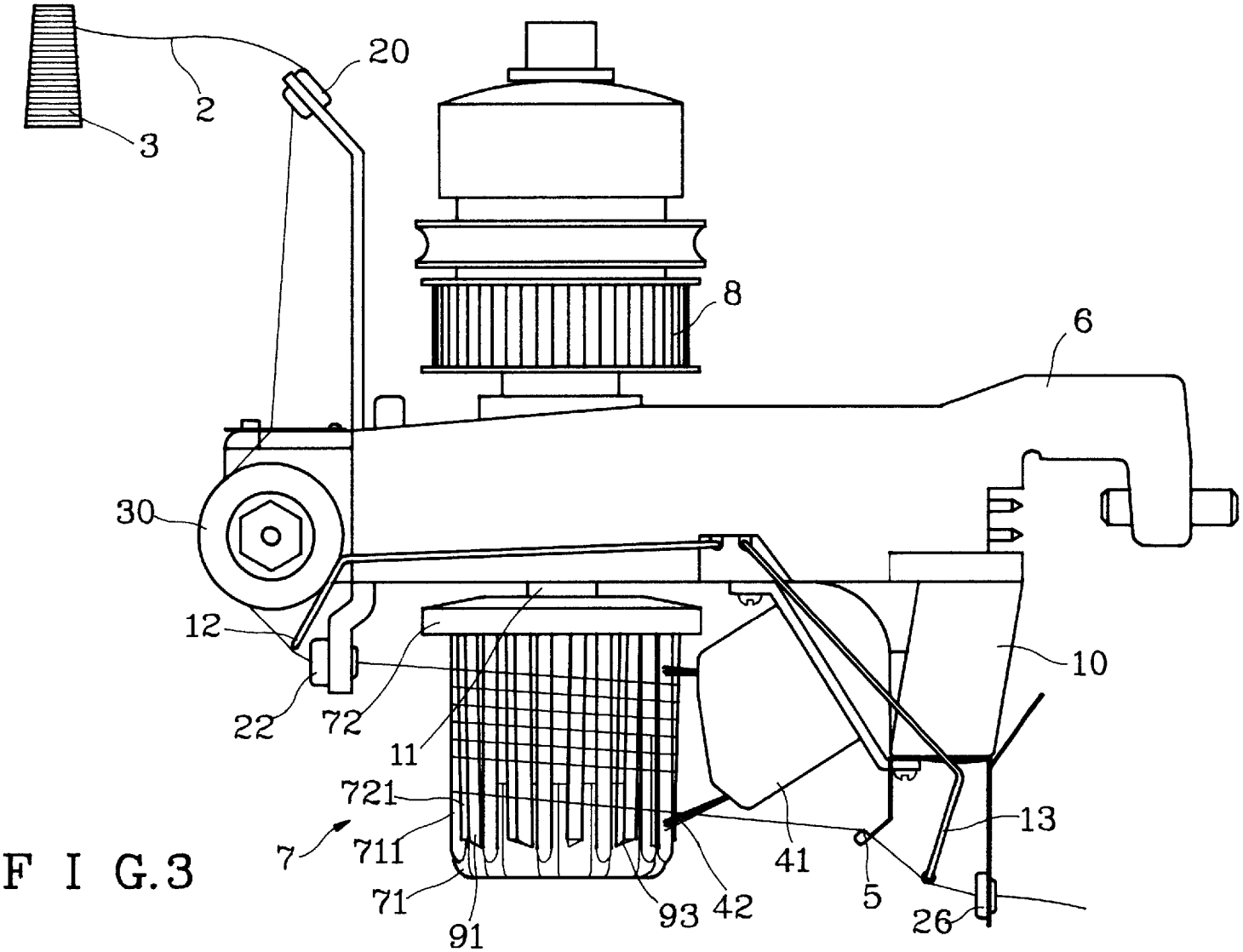
FIG. 3 is a side view of a yarn receiver of this invention.

Referring now to FIGS. 2 and 3, which show that the yarn receiver of the present invention is installed on a frame 6 of a yarn feeding means. The yarn feeding means enables a yarn 2 to travel from a yarn spindle 3, through a first porcelain ring 20, a filtering gauge 32, a yarn wheel 30, a first stop lever 12, a second porcelain ring 22, then wind around the yarn receiver 7 for a number of times. Thereafter, the yarn is led to a porcelain rod 5, a second stop lever 13, a third porcelain ring 26 to finally reach a needle for knitting operation.

The yarn receiver 7 is driven by a transmission shaft 11 which runs through the frame 6. One end of the transmission shaft 11 engages with a pulley 8 which is driven by a belt (not shown in the figures). Therefore the moving belt will drive the pulley 8 and the yarn receiver 7 to rotate concurrently.

Figure 6:
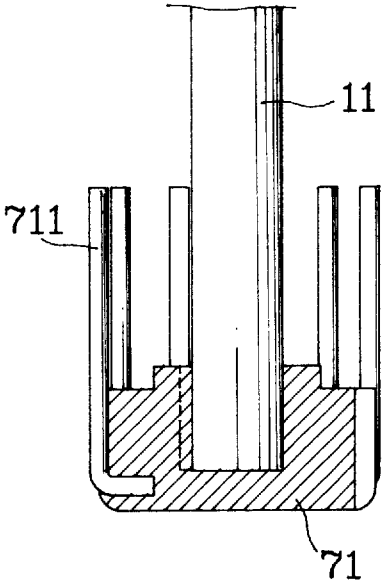
FIG. 6 is a sectional view of a driving reel.

The improvements in the yarn receiver 7 according to this invention include a driving reel 71 which is made by plastics injection molding. Referring to FIG. 6, the yarn receiver 7 engages with the transmission shaft 11 in the center and has a plurality of L-shaped struts 711 directed vertically upward around the rim of a bottom flange 712. The rim is curved and smooth with no protrusive edge.

Figure 4:
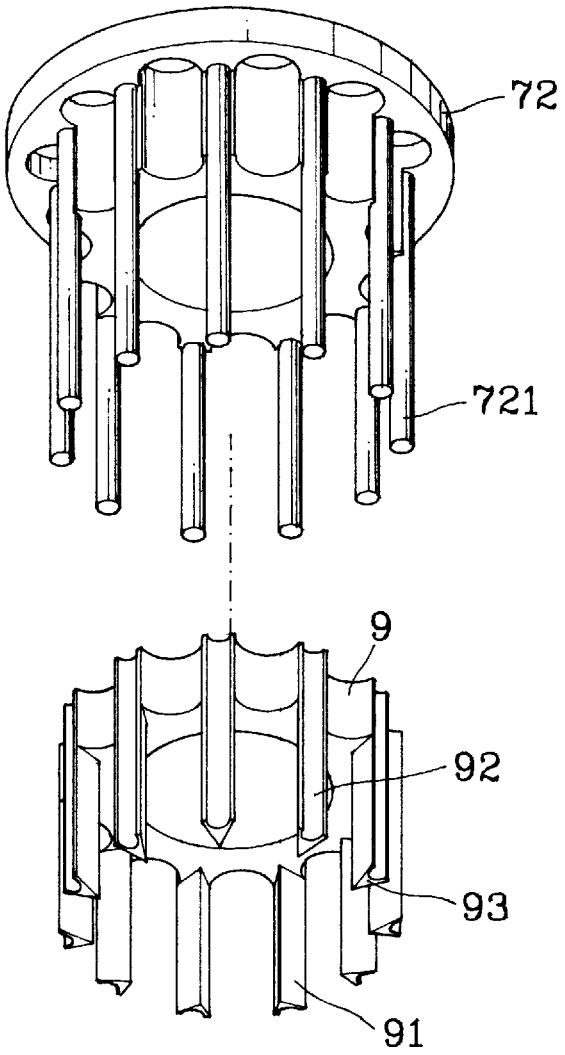
FIG. 4 is an exploded view of a driven reel of a yarn receiver of this invention.

Referring to FIG. 4, a driven reel 72 has a top flange 722 and downward pillars 721, whose number is the same as that of the struts 711. There is also a bushing reel 9 which has a plurality of sheaths 91, each having a concave surface 92 for holding a pillar 721 therein.

Figure 5:
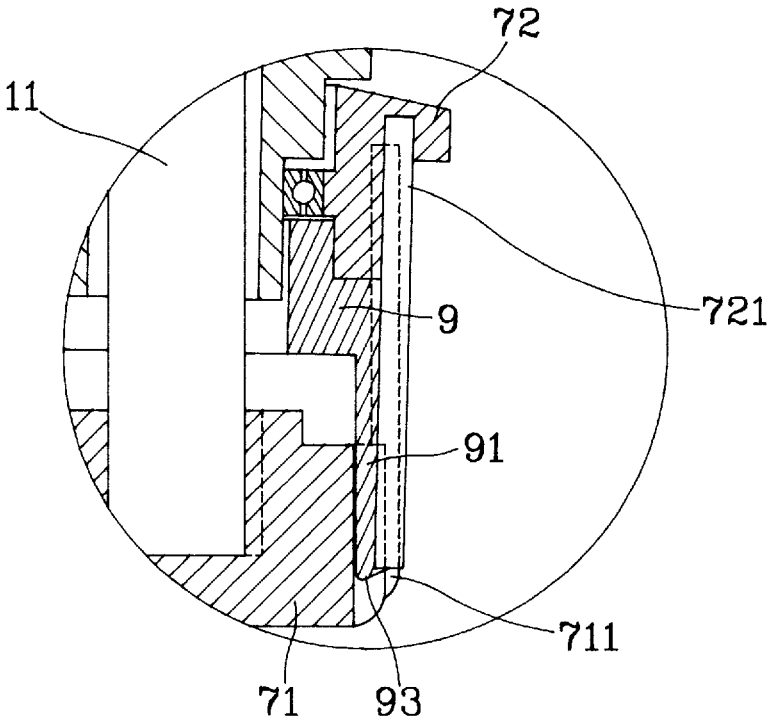
FIG. 5 is a fragmentary sectional view of a yarn receiver of this invention.

Referring to FIGS. 2 and 5, which show that, when in use, the driving reel 71 mates and engages with the driven reel 72 with the bushing reel 9 set between them. The struts 711 and the pillars 721 are staggered with each other alternately. The bottom end 93 of the sheath 91 withdraws slightly to the center. The upper end of the strut 711 also withdraws slightly to the center and thus forms a vertically inclined angle. The bottom annular circle formed by the pillars 721 has a smaller diameter than that formed by the struts 711. Therefore the yarns wound around the yarn receiver 7 will be prevented from falling to the bottom end of the pillars 721. Even if the yarns reach the bottom end, they will slip away from the sheath bottom end 93, and thus will not get caught by the pillar 721. Therefore yarn can be prevented from undue broken.

Since the driving reel 71 does not have a protrusive bottom flange, and each strut 711 has a smooth edge at the bottom end, the hards and refuses of yarn during knitting operation will be discharged off the driving reel 71 constantly without significant accumulation, which has been the problem encountered when using a conventional yarn receiver.

The driving reel 71, driven reel 72 and the bushing reel 9 are made by plastics injection molding. They can be easily produced with precise dimensions at low costs.

The present invention further provides a brush means 4 fixedly located on the frame 6. The tip of the brush 42 is located in a gap formed between the struts 711 and the pillar 721. The brush means 4 serves two purposes. One is to keep the yarn that has been wound around the yarn receiver from falling down. This feature is particularly useful for the yarns which have weak sticking property, or when the yarn feeding speed is low, resulting in the yarns loosely wound around the yarn receiver.

Another purpose of the present invention is to temporarily hold the hards and refuses of the yarn during the knitting operation until the accumulated hards and refuses reach a predetermined weight beyond the brush supporting capability. Then, the brush will tilt downwardly to allow the hards and refuses to drop out from the yarn receiver.

Field tests of the present invention showed that the strut 71 1 and pillar 721 provided the most desirable results when their lengths were about 35–55 mm. If the lengths were shorter than that, it will result in defective knitting products due to the fact that non-broken yarn could fall off from the yarn receiver. Longer than that, it will result in operation interference of a commonly used two-layer yarn feeding means, i.e., the yarn receiver at the upper layer will interfere with the operation of the yarn feeding means at the lower layer.

Figure 7:
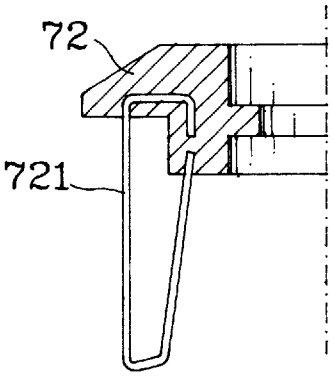
FIG. 7 is a fragmentary sectional view of another embodiment of a driven reel.

FIG. 7 illustrates another embodiment of the driven reel of the present invention. The pillar 721, instead of integrally formed with the top flange, is formed by a rod and then assembled with the top flange.

Figure 8:
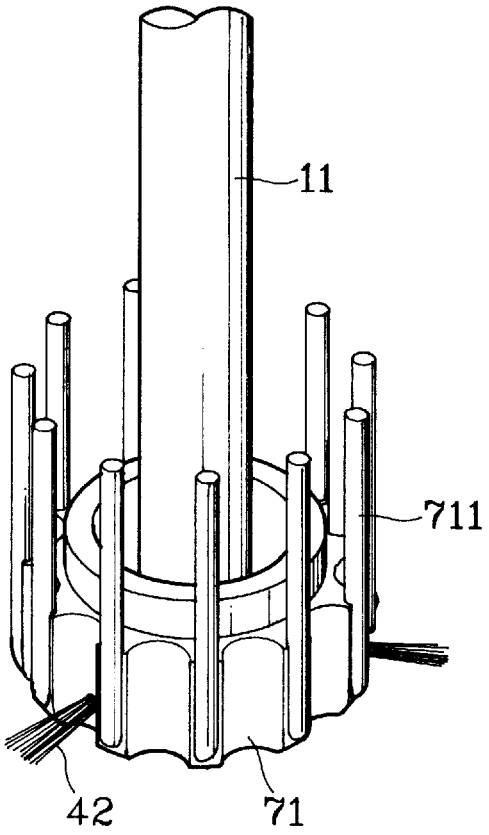
FIG. 8 is a perspective view of another embodiment of a driving reel with built-in brush means.

FIG. 8 shows another embodiment of a driving reel. The brush means 4 is built in the driving reel 71 with the brush 42 being projected outwardly.

It may thus be seen that the objects of the present invention set forth herein, as well as those made apparent from the foregoing description, are efficiently attained. While the preferred embodiment of the invention has been set forth for purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

I claim:

1. An improved yarn receiver for use in knitting machines, comprising:

a driving reel integrally formed by plastics injection molding having a transmission shaft in the center, a bottom flange with no protrusive edge and a plurality of spaced L-shaped struts formed around the rim of the bottom flange and projecting upwardly;

a driven reel having a top flange and a plurality of spaced pillars formed around the rim of the top flange and projecting downwardly;

a bushing reel integrally formed by plastics injection molding having a plural number of sheaths, each sheath holding a pillar, the pillars being positioned with the struts in a staggered manner;

a brush means located on a yarn feeding means for holding the yarns wound around the yarn receiver from falling off; and a pulley driven by a belt being engaged with one end of the transmission shaft; whereby the brush means will automatically discharge hards and refuses falling off from the yarn receiver.

2. The improved yarn receiver according to claim 1, wherein the pillar of the driven reel is formed by an elongated rod and assembled with the driven reel.

3. The improved yarn receiver according to claim 1, wherein the brush means is built upon a lateral side of the driving reel with the brush tip projecting outwardly.

4. The improved yarn receiver according to claim 1, wherein the length of the struts and the pillars are in the range of 35 to 55 mm.

* * * * *